US007070297B1

(12) United States Patent
Muhlnickel, Jr.

(10) Patent No.: US 7,070,297 B1
(45) Date of Patent: Jul. 4, 2006

(54) MULTIFUNCTION FLASHLIGHT

(76) Inventor: Donald L. Muhlnickel, Jr., 19519-2 Industrial Dr/, New Paris, IN (US) 46553

( * ) Notice: Subject to any disclaimer, the term of this patent is extended or adjusted under 35 U.S.C. 154(b) by 35 days.

(21) Appl. No.: 10/464,120

(22) Filed: Jun. 18, 2003

(51) Int. Cl.
*F21L 4/00* (2006.01)

(52) U.S. Cl. ..... 362/207; 362/202; 362/208

(58) Field of Classification Search ..... 362/202, 362/205–208
See application file for complete search history.

(56) References Cited

U.S. PATENT DOCUMENTS 1,518,575 A * 12/1924 Eaton ..... 362/205
2,882,388 A * 4/1959 Garland ..... 362/208
3,333,095 A * 7/1967 Moess ..... 362/207
4,314,317 A 2/1982 Robson
4,656,566 A 4/1987 Kelley
4,750,287 A 6/1988 Myers
4,916,588 A * 4/1990 Chu ..... 362/207
5,483,429 A * 1/1996 Chu ..... 362/207
5,611,615 A * 3/1997 Jang ..... 362/208
6,736,523 B1 * 5/2004 Alvey ..... 362/208
2002/0159248 A1 * 10/2002 Evenson ..... 362/208

* cited by examiner

*Primary Examiner*—Alan Cariaso
(74) *Attorney, Agent, or Firm*—Ronald D. Foster

(57) ABSTRACT

A flashlight having one or more storage areas while providing a means to attach useful accessories such as a can of pepper spray, compass or thermometer. The features of the invention allow the compass to be conveniently removed while still allowing the flashlight to operate. A portion of the storage area has a greater diameter than the tubular body of the flashlight to assist holding of the flashlight while separate storage spaces allow storing of spare batteries, light bulbs, other loose items or combinations of the like. In a separate feature of the invention, the intermediate cap has a cavity sized to receive and frictionally hold the flashlight.

10 Claims, 4 Drawing Sheets

MULTIFUNCTION FLASHLIGHT

BACKGROUND OF THE INVENTION

This invention relates generally to flashlights and, more particularly, to flashlights incorporating multi-functional storage compartments and attachments to provide added safety features.

Flashlights typically include a body having a light reflector structure mounted at one end of the body and a battery stored in the body. A light bulb located in the light reflector is connected to the battery via an electrical circuit including a switch. Space in the body may allow the storage of a spare light bulb. Likewise, a compass may also be incorporated, at the opposite end from the light reflector of the body of the flashlight, in the end cap.

Flashlights used in emergency situations such as in a home after an earthquake often suffer from inattention. A consequence of the inattention may be dead or low voltage batteries when most needed. Moreover the use of flashlights during such emergencies may preclude access to replacement batteries. Situations outside of the home also occur which dictate the use of flashlights in emergency situations. One such situation is the use of a flashlight when the user's airplane, boat, car or snowmobile suffers mechanical breakdown.

The flashlight briefly described above allows the user to operate the light by engaging the switch mechanism, but the flow of electricity creates a magnetic field which interferes with the compass mounted on the end of the flashlight body. Another problem associated with the flashlight described above is that the illuminating end is typically mounted at the opposite end from the compass which prevents the use of the flashlight to project light on the compass while navigating terrain in the dark. Still another problem associated with the above-described flashlight is inability to monitor the status of the battery except by monitoring the brightness of the light when the flashlight is in the on position. Still another problem associated with the above-described flashlights is their inability to store additional items needed by the user during emergency situations such as matches, lighters, space blankets, keys, personal defense items such as pepper spray or other useful items. Another problem with these flashlights is the lack of replacement light bulbs in combination with storage of useful accessories.

In the past, some of these undesirable characteristics have been avoided by the use of multiple flashlights which allow the monitoring of the compass with its respective light disengaged. Turning off the flow of electricity of the flashlight containing the compass eliminates the conflicting magnetic field. The second flashlight can then be used to illuminate the compass of the first flashlight. The second flashlight may also provide the needed redundancy when unmonitored flashlights have spent batteries. It should therefore be appreciated that there is a need for a flashlight configured to conveniently store replacement batteries, medicine, or other needed supplies in an emergency, which allows the removal of a compass while the flashlight may still operate.

SUMMARY OF THE INVENTION

The present invention is embodied in a flashlight assembly configured to store items including batteries and bulbs while providing a useful compass which may be monitored with the illumination of the flashlight. More particularly, the flashlight includes a cylindrical piggyback member having a greater diameter than the flashlight's tubular body. The tubular body holds a battery electrically connected to a bulb mounted in a light reflector. An intermediate cap, secured at the opposite end of the tubular body from the light reflector, connects the piggyback member to the tubular body. An end cap secured to a second end of the piggyback member provides a closed storage space in the piggyback member. The flashlight further incorporates a coiled compression spring, positioned between the intermediate cap and the battery, which causes the battery to maintain contact with the light reflector structure.

In more detailed features of the invention, the piggyback member threadably attaches to the intermediate cap which in turn is threadably connected to the tubular body. The intermediate cap includes a shoulder which frictionally receives the coiled compression spring and an annular recess containing an o-ring held in a groove which frictionally may hold a spare light bulb. Likewise, the end cap is threadably attached to a second end of the piggyback member. The end cap has an interior cavity on the interior side of the end cap which when enclosed by a cover plate provides a storage compartment. Additionally, the end cap may have an exterior cavity on the exterior side of the end cap configured with an annular groove to hold an o-ring which retains an attachment such as a can of pepper spray, thermometer or compass.

In a separate, independent feature of the invention, an alternative intermediate cap has a cavity sized to receive a tubular body, with a cap, of a flashlight. The cavity is further configured with an annular groove which receives an o-ring. The o-ring is sized to frictionally retain the tubular body of the flashlight. The intermediate cap then threadably engages the above-described piggyback member with end cap.

In a separate, independent feature of the invention, an alternative intermediate cap and end cap are configured to allow the piggyback member to be fixably attached in a position parallel to and alongside the body of the flashlight.

In another feature of the invention the male threads of the threaded connections of the intermediate cap retain an o-ring which augments the sealed connection between the intermediate cap and both the tubular body and the piggyback member. Likewise, the male threaded connection of the end cap retains an o-ring which augments the sealed connection between the end cap and the piggyback member.

Other features and advantages of the present invention will become apparent from the following description of the preferred embodiment, taken in conjunction with the accompanying drawings, which illustrate, by way of example, the principles of the invention.

DETAILED DESCRIPTION OF THE PREFERRED EMBODIMENTS

Figure 1:
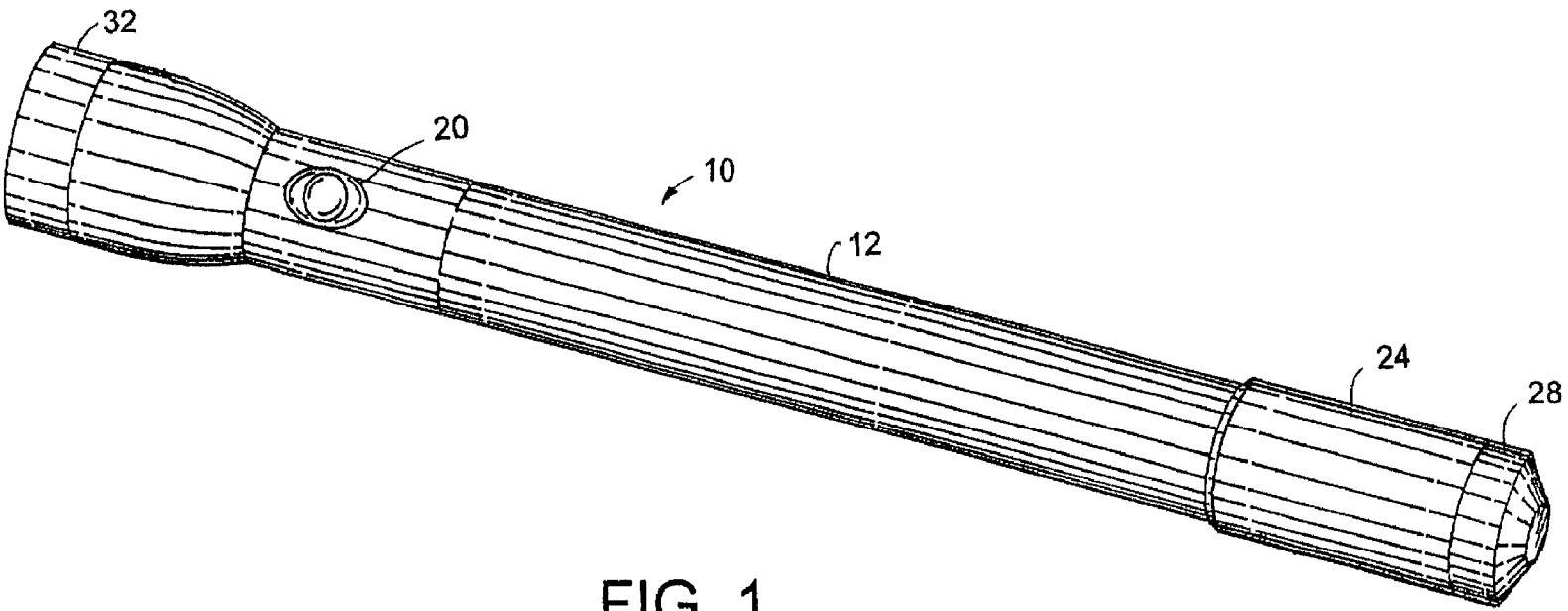
FIG. 1 is a perspective view of the flashlight assembly.
Figure 2:
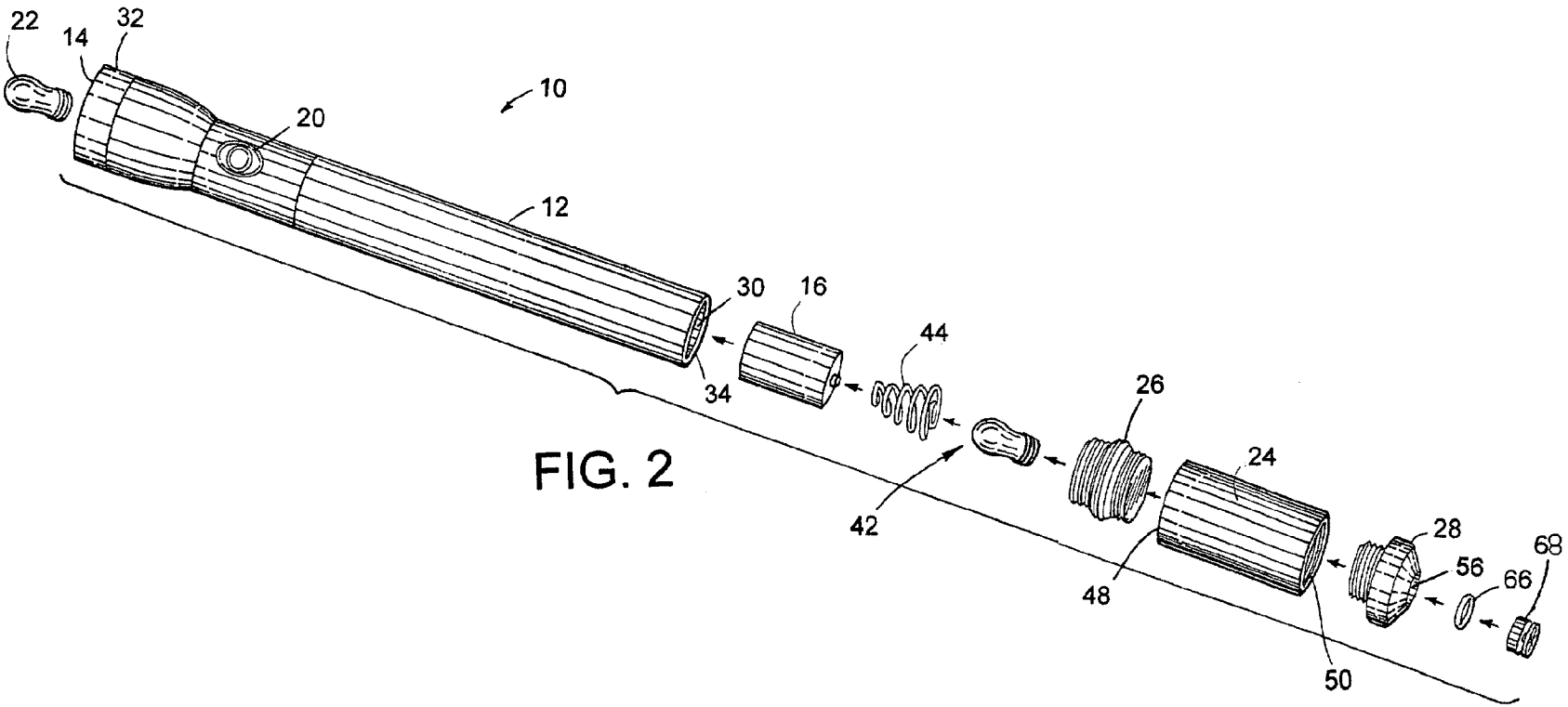
FIG. 2 is an exploded view of the flashlight assembly of FIG. 1.
Figure 3:
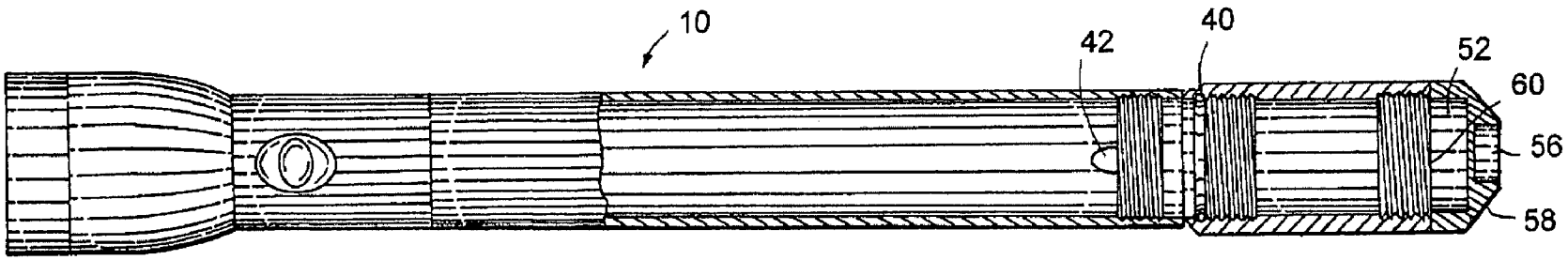
FIG. 3 is a cross-sectional view of the flashlight assembly of FIG. 1.
Figure 4:
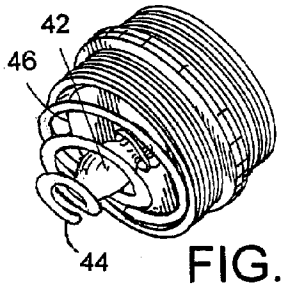
FIG. 4 is a perspective view of the coiled spring side of the intermediate cap.

As shown in the exemplary drawings, and particularly in FIGS. 1 and 2, the invention is embodied in a flashlight (10) including a tubular body (12), a light reflector (14), a battery (16), an electrical circuit not shown including a switch (20), a light bulb (22), a cylindrical piggyback member (24) having a greater diameter than the tubular body, an intermediate cap (26), and an end cap (28). The tubular body, defining a space (30) in which the battery is maintained. The tubular body has a head end (32) and an intermediate end (34). The light reflector structure is secured to the head end portion of the tubular body and the light bulb is secured in the light reflector structure. Power from the battery is provided to the light bulb by the electrical circuit which may be interrupted by the switch. As shown by example in FIG. 6, the intermediate cap has an annular recess (72) which is configured with an annular groove (74) sized to receive an o-ring (78). The o-ring is sized to frictionally retain a spare bulb (42). The intermediate cap is secured to the tubular body at the intermediate end of the tubular body. A coiled compression spring (44), positioned between the intermediate cap and the battery, causes the battery to come in contact with the light reflector structure. The coiled spring is positioned by an annular ridge (46). A first end (48) of the piggyback member threadably attaches to the intermediate cap. Likewise, the end cap is threadably attached to a second end (50) of the piggyback member. The end cap has a storage compartment (52) on the interior side (54) of the end cap and an exterior cavity (56) on the exterior side (58) of the end cap. A cover plate (60) frictionally engages the edge (62) of the storage compartment to enclose said storage compartment. The exterior cavity is configured with an annular groove (64) which receives an o-ring (66). The o-ring is sized to frictionally retain an accessory (68), such as pepper spray can, thermometer or compass.

Figure 5:
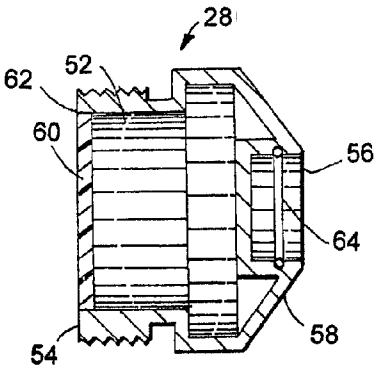
FIG. 5 is a cross-sectional view of the end cap.
Figure 6:
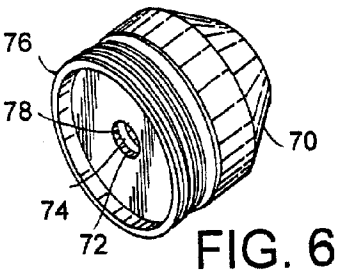
FIG. 6 is a perspective view of the alternative end cap.

As shown in FIG. 6, an alternative embodiment of the invention has an intermediate end cap (70) which includes two annular recesses. The interior annular recess (72) is in the inside (76) of the intermediate cap. The interior annular recess has an annular groove (74) sizes to receive an o-ring (78). The o-ring is sized to frictionally retain a spare light bulb (42). As shown by example in FIG. 5, the exterior annular recess, (56) is in the exterior side (58) of intermediate end cap. The exterior annular recess has an annular groove (64) in which an o-ring (66) is positioned. The o-ring is sized to retain an accessory (68) such as a can of pepper spray, compass or thermometer. The o-ring allows the user to easily remove and exchange one such sensor for another.

Figure 7:
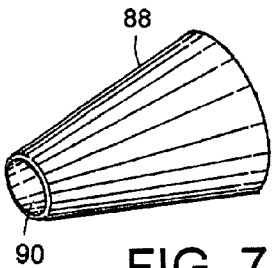
FIG. 7 is a perspective view of the alternative intermediate cap.
Figure 8:
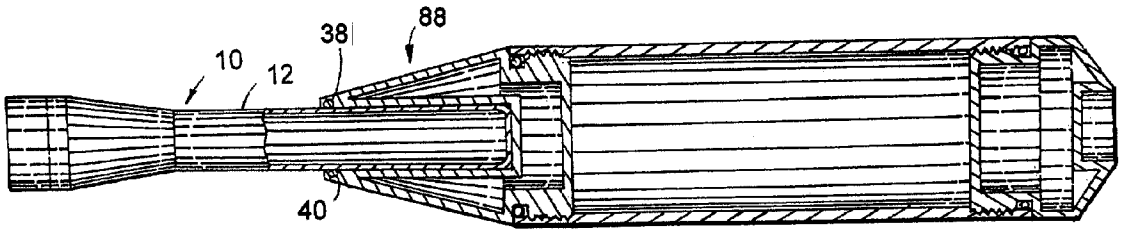
FIG. 8 is a fragmentary cross-sectional view of a flashlight assembly including the alternative intermediate cap of FIG. 7.

As shown in FIGS. 7 and 8, an alternative embodiment of the invention has an intermediate cap (88) with an annular recess (90). The annular recess is configured with an annular groove (38) sized to receive an o-ring (40). The o-ring is sized to receive the tubular body (12) of the flashlight (10).

Those skilled in the art will recognize that the flashlight assembly may be fabricated from various materials. However, the tubular body and piggyback member are preferably manufactured of aluminum for economy, durability and ease of production. Likewise, the gaskets and O-rings are preferably made of a plastic like material or rubber like material.

What is claimed is:

1. A flashlight comprising:

a body, a light reflector structure, one or more batteries, an electrical circuit including a switch, a light emitting member, a piggyback member, an intermediate cap, and an end cap; the body, defining a space in which the battery is maintained, and having a head end and an intermediate end; the light reflector structure is secured to the head end portion of the body and the light emitting element is secured in the light reflector structure;

power from the battery is provided to the light emitting element by the electrical circuit which may be interrupted by the switch; the intermediate cap is secured to the body at the intermediate end of the body; a biasing means disposed between the intermediate cap and the battery compels the battery to a predetermined position in contact with the light reflector structure; a first end of the piggyback member is secured to the intermediate cap while the end cap is secured to a second end of the piggyback member thereby defining a closed space within the piggyback member; said piggy back member being substantially cylindrical in shape, and said body being substantially tubular and the cylindrical shape of the piggyback member having a larger diameter than the tubular body.

2. The flashlight of claim 1 wherein the piggyback member is removably secured to the intermediate cap.

3. The flashlight of claim 1 wherein the piggyback member consists of aluminum.

4. The flashlight of claim 1 wherein the intermediate cap defines one or more cavities.

5. The flashlight of claim 4 wherein the intermediate cap is configured such that at least one of the one or more cavities may removably receive a spare light emitting element.

6. The flashlight of claim 1 wherein the intermediate cap is threadably secured to the body and the piggyback member.

7. The flashlight of claim 6 wherein the intermediate cap consists of aluminum.

8. A flashlight comprising:

a body, a light reflector structure, one or more batteries, an electrical circuit including a switch, a light emitting member, a piggyback member, an intermediate cap, and an end cap; the body, defining a space in which the battery is maintained, and having a head end and an intermediate end; the light reflector structure is secured to the head end portion of the body and the light emitting element is secured in the light reflector structure;

power from the battery is provided to the light emitting element by the electrical circuit which may be interrupted by the switch; the intermediate cap is secured to the body at the intermediate end of the body; a biasing means disposed between the intermediate cap and the battery compels the battery to a predetermined position in contact with the light reflector structure; a first end of the piggyback member is secured to the intermediate cap while the end cap is secured to a second end of the piggyback member thereby defining a closed space within the piggyback member; said piggy back member being substantially cylindrical in shape, and said body being substantially tubular and the cylindrical shape of the piggyback member having a larger diameter than the tubular body; the end cap defining a cavity in the interior side of the end cap; the end cap having a cover that may be secured to the interior cavity of the end cap.

9. The flashlight of claim 8 wherein the end cap defines a cavity on the exterior side of the end cap configured to receive an accessory.

10. A flashlight comprising:

a substantially tubular body, a light reflector, one or more batteries, an electrical circuit including a switch, a light emitting member, a substantially cylindrical piggyback member having a greater diameter than the tubular body, an intermediate cap, and an end cap; the tubular body, defining a space in which the battery is maintained, and having a head end and an intermediate end; the light reflector structure is secured to the head end portion of the tubular body and the light emitting element is secured in the light reflector structure; power from the battery is provided to the light emitting element by the electrical circuit which may be interrupted by the switch; the intermediate cap, which defines one or more cavities wherein one of the one or more cavities is configured to frictionally receive a spare lighting element, is secured to the body at the intermediate end of the tubular body; a coiled compression spring disposed between the intermediate cap and the battery compels the battery to a predetermined position in contact with the light reflector structure; a first end of the piggyback member is removably secured to the intermediate cap while the end cap is secured to a second end of the piggyback member thereby defining a closed space within the piggyback member; the end cap defines a cavity on the interior side as well as a cavity on the exterior side of the end cap, wherein the interior cavity is configured to secure a cover plate thereby creating a storage area, and the exterior cavity is configured to secure an accessory.

* * * * *